US012668924B2

(12) United States Patent
Eberhardt

(10) Patent No.: US 12,668,924 B2
(45) Date of Patent: Jun. 30, 2026

(54) PAPER MACHINE CLOTHING AND METHOD

(71) Applicant: Voith Patent GmbH, Heidenheim (DE)

(72) Inventor: Robert Eberhardt, Ellwangen (DE)

(73) Assignee: Voith Patent GmbH, Heidenheim (DE)

( * ) Notice: Subject to any disclaimer, the term of this patent is extended or adjusted under 35 U.S.C. 154(b) by 324 days.

(21) Appl. No.: 17/626,977

(22) PCT Filed: May 20, 2020

(86) PCT No.: PCT/EP2020/064037
§ 371 (c)(1),
(2) Date: Jan. 13, 2022

(87) PCT Pub. No.: WO2021/008758
PCT Pub. Date: Jan. 21, 2021

(65) Prior Publication Data

US 2022/0275580 A1 Sep. 1, 2022

(30) Foreign Application Priority Data

Jul. 15, 2019 (DE) ..... 10 2019 119 047.9

(51) Int. Cl.
*D21F 7/08* (2006.01)
*D04H 1/46* (2012.01)
(Continued)

(52) U.S. Cl.
CPC ..... *D21F 7/083* (2013.01); *D04H 1/46* (2013.01); *D04H 1/5418* (2020.05); *D04H 1/549* (2013.01); *D04H 1/556* (2013.01)

(58) Field of Classification Search
CPC ..... D21F 7/083; D04H 1/5418; D04H 1/46; D04H 1/549; D04H 1/556
See application file for complete search history.

(56) References Cited

U.S. PATENT DOCUMENTS 4,541,895 A * 9/1985 Albert ..... D21F 1/0063 428/137
4,571,359 A 2/1986 Dutt
(Continued)

FOREIGN PATENT DOCUMENTS

CN 103392037 A 11/2013
DE 19803493 C1 4/1999
(Continued)

OTHER PUBLICATIONS https://www.ensingerplastics.com/en/thermoplastic-materials/pa-polyamide#:~:text=These%20polyamide%20properties%20vary%20from,C%20and%20260%20%C2%B0C. (Year: 2023).*
(Continued)

*Primary Examiner* — Abbas Rashid
*Assistant Examiner* — Stephen M Russell
(74) *Attorney, Agent, or Firm* — Laurence A. Greenberg; Werner H. Stemer; Ralph E. Locher

(57) ABSTRACT

A paper machine clothing, in particular a press felt, for a machine for producing or processing a fibrous material web, includes a base structure and at least one layer of nonwoven fibers disposed on the base structure. The layer of nonwoven fibers has bonding fibers and further fibers. The bonding fibers and the further fibers differ in at least one material property, and at least some of the bonding fibers are connected to one or more further fibers and/or elements of the base structure by an integral joining connection, in particular a weld connection. A method for producing the clothing is also provided.

12 Claims, 2 Drawing Sheets

(51) Int. Cl.

| | |
|---|---|
| ***D04H 1/541*** | (2012.01) |
| ***D04H 1/549*** | (2012.01) |
| ***D04H 1/556*** | (2012.01) |

(56) References Cited

U.S. PATENT DOCUMENTS

| | | | | |
|---|---|---|---|---|
| 6,660,362 | B1 * | 12/2003 | Lindsay | D21F 11/145 162/902 |
| 7,722,743 | B2 | 5/2010 | Best et al. | |
| 9,309,624 | B2 * | 4/2016 | Straub | D21F 1/0036 |
| 10,844,540 | B2 | 11/2020 | Eberhardt et al. | |
| 2009/0056900 | A1 * | 3/2009 | O'Connor | D21F 1/0027 156/181 |
| 2013/0333792 | A1 | 12/2013 | Eberhardt et al. | |

FOREIGN PATENT DOCUMENTS

| | | | |
|---|---|---|---|
| DE | 102007000578 | A1 | 4/2009 |
| DE | 202012100695 | U1 | 5/2013 |
| DE | 102016206384 | A1 | 10/2017 |
| EP | 1837440 | A1 | 9/2007 |
| WO | 8501693 | A1 | 4/1985 |

OTHER PUBLICATIONS https://www.ensingerplastics.com/en-us/shapes/engineering-plastics/pa-polyamide (Year: 2019).*
https://prestoflooring.com/polyurethane-melting-temperature/ (Year: 2023).*
https://www.linseis.com/en/wiki/polyethyleneterephthalate-pet-an-in-depth-investigation/#:~:text=The%20melting%20point%20of%20PET,weight%20and%20high%20tensile%20strength (Year: 2024).*

* cited by examiner

PAPER MACHINE CLOTHING AND METHOD

FIELD AND BACKGROUND OF THE INVENTION

The invention relates to a clothing, in particular a press felt, for a machine for producing or processing a fibrous material web, including a base structure and at least one layer of nonwoven fibers disposed on the base structure, the layer of nonwoven fibers including bonding fibers and further fibers. The invention also relates to a method for producing a clothing, in particular a press felt, for a machine for producing or processing a fibrous material web.

For the production of fibrous material webs such as paper, clothings in which a covering on nonwoven fibers is arranged on a base structure have for a long time been used in the pressing part, but also at other positions such as, for example, in the dry part. Such coverings may consist of fibers with different fineness. The connection of the nonwoven covering to the base structure, as well as the anchoring of the nonwoven fibers to one another, are achieved by needling.

In many applications, however, improved anchoring of the nonwoven fibers to one another or to the base structure is required. To this end, various approaches are known from the prior art.

For example, WO 85/01693 describes the use of hot-melt adhesives with a lower melting point than the nonwoven fibers. During the heating, this adhesive melts and connects the nonwoven fibers to one another.

As an alternative, it is proposed in DE 198 03 493 to introduce bicomponent fibers, which consist of a carrier component and a lower-melting adhesive component, into the fiber nonwoven. In this case as well, nonwoven fibers are connected to one another by the adhesive component.

A disadvantage with these methods is that an additional adhesive material is introduced into the fiber nonwoven in order to connect the nonwoven fibers to one another or to the base structure. This material must have a lower melting point than the rest of the nonwoven fibers. The possibilities in the design of such a felt are thereby restricted. It is furthermore necessary to avoid the melting temperature of this adhesive material being too close to the operating temperature of the system (for example during dry felting in the dry part) since the adhesive connections are then broken again during operation of the clothing.

SUMMARY OF THE INVENTION

It is therefore an object of the present invention to provide a clothing which allows improved anchoring of the nonwoven fibers to one another or to the base structure, without the restrictions of the prior art in the material selection.

It is furthermore an object of the invention to ensure that this anchoring is maintained even at high operating temperatures of the clothing.

The objects are fully achieved by a clothing according to the invention and by a method for producing a clothing according to the invention. Advantageous embodiments are described in the dependent claims.

In respect of the clothing, the object is achieved by a clothing, in particular a press felt, for a machine for producing or processing a fibrous material web, comprising a base structure and at least one layer of nonwoven fibers arranged on the base structure. According to the invention, the layer of nonwoven fibers comprises bonding fibers and further fibers, the bonding fibers and the further fibers differing in at least one material property, at least some of the bonding fibers being connected to one or more further fibers and/or the base structure by means of a material joining connection, in particular a weld connection.

In a clothing as described above, by means of the material joining connections the bonding fibers serve to increase the internal strength of the nonwoven layer or for better connection of the nonwoven layer to the base structure. There is, however, a substantially free choice in the material selection of these bonding fibers. In particular the limitation known from the prior art, that the melting point of the bonding fibers must be below the melting point of the rest of the fibers, is avoided. Although this selection may be made if so desired by the user or manufacturer, it is not necessary in order to achieve the increase in strength.

It is particularly advantageous for the connection of the bonding fibers to the further fibers to take place by means of a weld connection. To this end the joining partners, i.e. in this case the bonding fibers and further fibers, only have to be locally melted in the region of the connection position. Thorough heating of the entire nonwoven layer, as when using known hot-melt adhesives, may therefore be avoided. This is advantageous not only in respect of the energy input required. It also prevents structural modifications or weakenings of the further nonwoven fibers.

Unless otherwise explicitly mentioned, in the scope of this application all of the nonwoven fibers which are arranged on one side of the clothing are to be referred to as the nonwoven layer of this side. Such a nonwoven layer is conventionally composed of a plurality of levels of nonwoven fibers with different fineness, etc. The bonding fibers, or the material joining connections between bonding fibers and further fibers, may in this case occur in all these levels, and in particular these joining connections may be distributed homogeneously over the entire nonwoven covering.

As an alternative, the bonding fibers, or the material joining connections between bonding fibers and further fibers, may be provided only in some of the levels, in particular only in one of these levels.

Depending on the application, a clothing may comprise a nonwoven layer only on one side, conventionally on the side in contact with the paper. Nonwoven layers may, however, also be provided on the paper side and the backing side of the clothing. In such a clothing, bonding fibers may be provided only in the nonwoven layer of one side or in both nonwoven layers.

According to one particularly preferred embodiment of the invention, the bonding fibers differ from the further fibers in that they substantially absorb NIR radiation in a wavelength range, this absorption wavelength range lying between 780 nm and 1100 nm, in particular between 790 [nm] and 1000 nm, preferably between 820 nm-980 nm, while the further fibers are entirely or substantially transparent for radiation in this wavelength range. This is moreover not intended to mean that the bonding fibers necessarily absorb in the entire spectrum between 780 nm-1100 nm (or 790-1000 nm or 800-980 nm), but merely that there is at least one absorption wavelength range within this interval. The width of the absorption wavelength range may in this case be for example 50 nm or 100 nm, or alternatively less or more. The same also applies—mutatis mutandis—for the further fibers, which also need to be entirely or substantially transparent only in the absorption wavelength range.

Absorbent is intended in the scope of this application to mean fibers or materials which absorb more than 50%, in particular more than 70%, preferably more than 85% of the incident radiation.

Substantially absorbent may also mean fibers or materials which absorb more than 40% of the incident radiation.

Transparent, on the other hand, is intended to mean fibers or materials which absorb less than 25%, advantageously less than 15%, of the incident radiation.

Such nonwoven layers are advantageous in particular because the material joining connections between the bonding fibers and the further nonwoven fibers can be produced by transmission welding. If such a nonwoven layer is irradiated with light in the absorption wavelength range, the bonding fibers absorb the energy and heat up, while the light passes through the further fibers and these fibers remain substantially cold. Only at contact positions between a bonding fiber and a further fiber is the contact position of the further fiber locally heated by the temperature of the bonding fiber. The surface of the further fiber may therefore possibly melt locally and a material joining connection is formed between the two fibers without entailing the risk of significant damage or weakening of the material properties of the further fiber by excessive temperatures.

The comments above also apply mutatis mutandis for the formation of material joining connections between the bonding fibers and the base structure.

In this case, it should be noted that base structures of clothings, for example press felts, are often made of a polyamide. Polyamide is likewise a common polymer for the production of nonwoven fibers. These polyamides are substantially transparent in the range between 780 nm and 1100 nm.

Bonding fibers with such absorption properties may, for example, be produced by providing absorber additives which absorb NIR radiation in the range between 780 nm and 1100 nm, in particular between 790 nm and 1000 nm, preferably between 820 nm-980 nm, in or on the bonding fibers.

Advantageously, the transmission welding may be carried out as NIR transmission welding.

In further preferred embodiments, the transmission welding may be carried out as laser transmission welding. As an alternative, however, a different light source may be used instead of a laser.

In very particularly preferred embodiments, NIR laser transmission welding may be used.

The use of such absorber additives has many advantages. On the one hand, they are readily and relatively inexpensively available. For example, carbon black is a highly suitable absorber additive. Suitable uncolored absorbers, which are sold for example under the name "Clearweld", are however also available on the market.

On the other hand, the polymer material of the fibers may also be selected here independently of its absorption properties. In particular, it is possible for the bonding fibers and the further fibers to consist of the same polymer material—for example a polyamide, the additive merely being mixed with the bonding fibers in order to achieve the different absorption behavior. In contrast to the adhesive fibers of the prior art, the bonding fibers are therefore not foreign bodies in the nonwoven layer but have substantially the same properties as the further fibers.

An absorber additive may in this case optionally be added to the mass of the bonding fibers and distributed more or less uniformly throughout the entire bonding fiber. As an alternative, the additive may however also be provided entirely or primarily on the surface of the bonding fibers. The effect of this is that also the bonding fibers are only heated on the surface when irradiated in the corresponding wavelength, and the bonding fiber substantially remains structurally unmodified internally. One embodiment of this involves BiCo fibers having two components, a core material, which need not be absorbent, being surrounded by a coating of absorbent material.

In this case, it is advantageous for the core material to constitute at least 40%, in particular between 50% and 60%, of the volume of the bonding fibers.

In the case of bonding fibers with a circular diameter, the diameter of the core material may constitute more than 60%, preferably between 70% and 80%, of the diameter of the bonding fiber.

In some advantageous embodiments, the proportion of the bonding fibers in the entire layer of nonwoven fibers may be less than 30 wt %, in particular less than 15 wt %, particularly preferably less than 8 wt %. A preferred range lies between 2 wt % and 6 wt %.

A further advantage of the clothings according to one aspect of the invention is that the proportion of the bonding fibers in the entire nonwoven layer may also be selected flexibly. In practice, it will often be selected in such a way that the desired improvement of the fiber anchoring is achieved. Since the bonding fibers may have substantially the same properties as the further fibers, even increasing the proportion of the bonding fibers does not lead to a corresponding modification of the properties of the fiber nonwoven. In these clothings, a higher proportion of bonding fibers may therefore also be used than is possible with the known melting fibers. The aforementioned proportion of 30 wt % of bonding fibers does not represent an upper limit. If a further increase of the fiber anchoring is needed, an even greater proportion of bonding fibers is also possible.

In particular, the further fibers may all be made from the same polymer material.

In this case, it may be advantageous for the bonding fibers to consist entirely or predominantly of the same polymer material as the further fibers.

As an alternative, however, the bonding fibers may also consist entirely or predominantly of a different polymer material than the further fibers. Predominantly in this case means by more than 50 wt %.

It is advantageous for the material pairing of the bonding fibers and the further fibers to be compatible in the sense that they form a stable weld connection to one another. This is naturally the case for identical polymers. One example of a compatible pairing of different polymers is PA 6 with PA 6.6.

One disadvantage of the known melting fibers is in fact that they must necessarily have a melting point which lies below the melting point of the further fibers. This restriction is removed with a clothing according to one aspect of the present invention.

Specifically, the melting temperature of the bonding fiber may in particular advantageously be equal to or greater than that of the further fibers. This becomes possible since it is not the entire nonwoven layer that is thoroughly heated, but rather only the bonding fibers or else only the joining position between the fibers.

Considering an embodiment with absorbent bonding fibers, the nonwoven layer may be irradiated with suitable light (for example laser light) until the bonding fibers have been heated close to their melting point by absorbing energy. Since the further fibers are transparent, they do not heat up, or do so at most in the region of the positions of contact with the bonding fibers. The melting temperature of the bonding fibers may therefore also be greater than that of the further fibers, without the further fibers being structurally damaged during the production of the material joining connections.

It may be advantageous for the bonding fibers to consist entirely or predominantly of a polyamide, a copolyamide, polyurethane or polyether-block-polyamide copolymer (PEBA).

Predominantly in this case means by more than 50 wt %. In particular, the bonding fibers may also contain additives in addition to the polymer material. These may be absorber additives and/or other suitable additives.

The further fibers need not be entirely uniform fibers. The further fibers may advantageously comprise at least two types B1 and B2 of fibers, in which case type B1 and type B2 may differ in particular in titer and/or polymer material.

Particularly in relation to the fiber titer, more than two types of further fibers may of course also be provided.

In the event that a plurality of types of further fibers are provided, the feature that the bonding fibers and the further fibers differ in at least one material property may be understood as meaning that there is a feature in which the bonding fibers differ from all further fibers. This may in particular be the absorption behavior.

For example, further fibers consisting of a polyamide may be provided together with further fibers consisting of a polyurethane. In this case, the two types of further fibers are selected to be transparent for light in the range of 780 nm and 1100 nm, while the bonding fibers absorb light in this range. The above-described process of transmission welding may therefore be carried out.

All base structures known from the field of clothings are suitable as a base structure. In particular, the base structure may comprise or consist of a fabric, a noncrimp or a sheet.

For the production of the clothing, it may be advantageous for the base structure to be transparent for light in the range of between 780 nm and 1100 nm, in particular between 790 nm and 1000 nm, preferably between 820 nm-980 nm.

It may be advantageous for the layer of nonwoven fibers to be connected to the base structure by needling. The combination of needling and the described material joining connections leads to greatly improved fiber anchoring.

Furthermore, some of the bonding fibers may be connected to one or bonding fibers by means of a material joining connection, in particular a weld connection.

In respect of the method, the object is achieved by a method for producing a clothing, in particular a press felt, for a machine for producing or processing a fibrous material web, wherein the method comprises the steps:

a) arranging a layer of nonwoven fibers on a base structure, the layer comprising bonding fibers and further fibers, which differ in at least one material property b) generating material joining connections between bonding fibers and further fibers by controlled energy input.

In this case as well, advantageous embodiments are described in the dependent claims.

Preferably, the layer of nonwoven fibers may comprise bonding fibers which absorb NIR radiation in a wavelength range which lies between 780 nm and 1100 nm, and the controlled energy input may be carried out by irradiation in this wavelength range.

Furthermore, the irradiation may be carried out with the action of a joining pressure onto the nonwoven layer.

In one advantageous embodiment, the method may comprise the step c) connecting the layer of nonwoven fibers to the base structure, in which case the connection may in particular be carried out by needling.

Step c may be carried out before or after step b.

If the needling is carried out before the energy input and if the energy input is carried out by NIR (laser) transmission welding, it is advantageous for the base structure to be substantially transparent for the laser light used, since otherwise the risk arises that the base structure will be heated by the energy input and possibly damaged.

The controlled energy input may be carried out by irradiation from one side or from both sides of the layer of nonwoven fibers. Irradiation from both sides may in this case take place either simultaneously, or one side after the other.

The invention will be explained in more detail below with the aid of schematic figures, which are not true to scale.

DETAILED DESCRIPTION OF THE INVENTION

Figure 1:
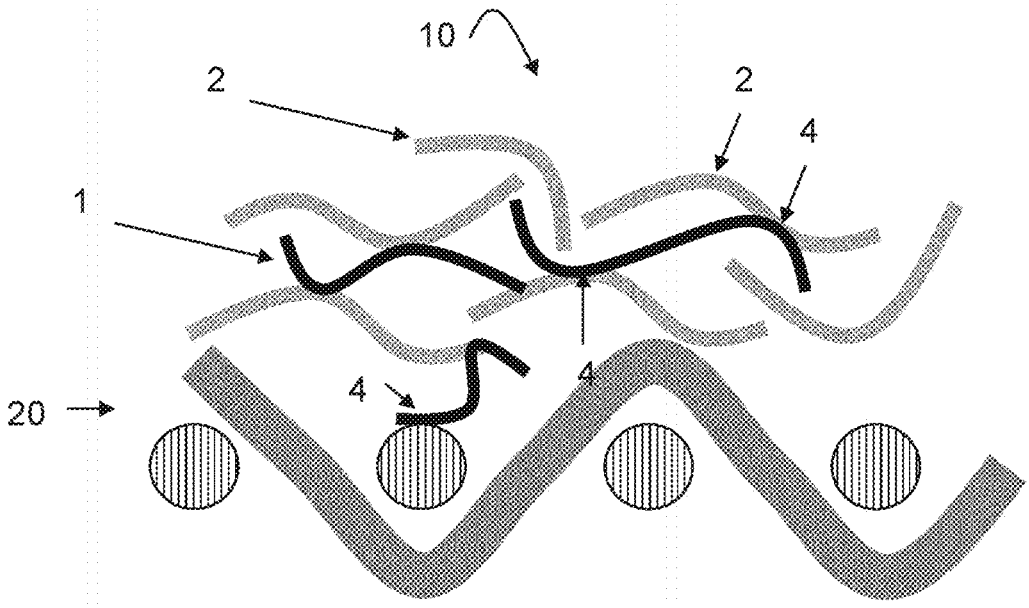
FIG. 1 shows a detail of a clothing according to one aspect of the invention.

FIG. 1 schematically shows a small detail of a clothing according to one aspect of the invention. The clothing is in this case configured as a press felt. Here, the felt comprises a nonwoven layer 10 and a base structure 20, which is configured here as a base fabric 20. As an alternative, other base structures 20, for example a noncrimp or sheet structures, may however also be envisioned. The nonwoven layer 10 in this case comprises a number of bonding fibers 1 as well as further fibers 2. At a number of joining positions, the bonding fibers 1 are connected by means of material joining connections 4 to the further fibers 2. As shown by way of example in FIG. 1, the bonding fibers may also be connected to the base structure 20 by means of material joining connections 4. In FIG. 1, the joining connection 4 exists between a warp or weft thread of the woven base structure 20.

In some advantageous embodiments, the nonwoven layer 10 is furthermore also connected to the base fabric 20 by needling. This also leads to an additional mechanical connection of the nonwoven fibers to one another.

The felt shown in FIG. 1 comprises a nonwoven layer 10 only on one side, specifically on the paper side. As an alternative, a further nonwoven layer may be provided on the backing side. According to one aspect of the invention, this layer may be configured with or without bonding fibers.

The further fibers 2 of the nonwoven layer 10 may all be identical. Often, however, they will differ in properties such as the fiber diameter or titer, or sometimes also the polymer material used. In the example of FIG. 1, the bonding fibers 1 differ from the further fibers 2 in that they substantially absorb NIR radiation in a range between 780 nm and 1100 nm, while the further fibers are entirely or substantially transparent for radiation in this wavelength range. The material joining connections in the form of weld connections may thus be produced straightforwardly by means of NIR laser transmission welding.

Figure 2:
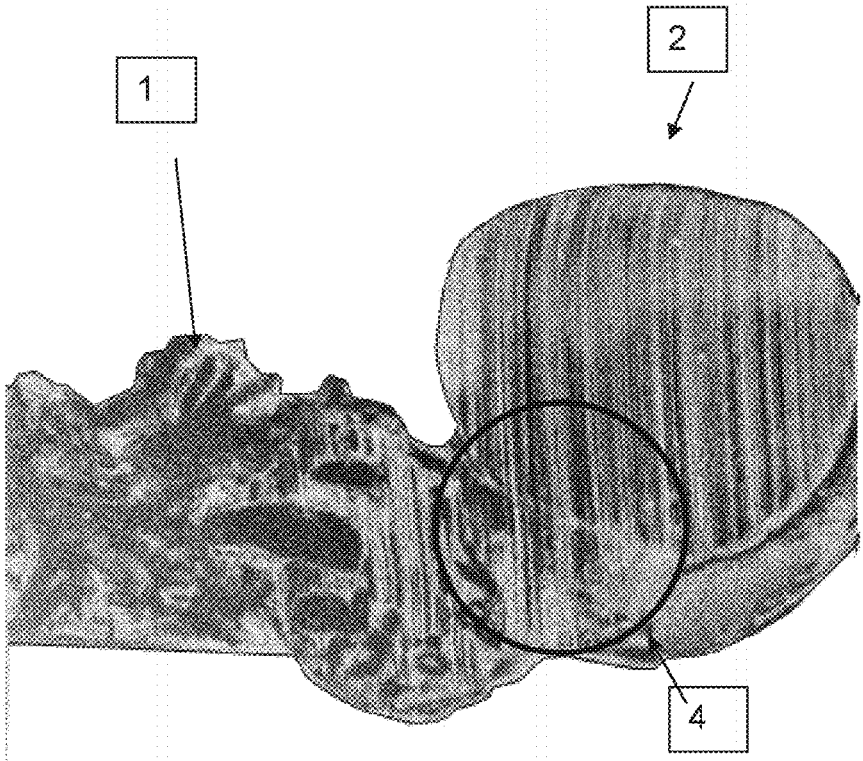
FIG. 2 shows a material joining connection according to a further aspect of the invention.

FIG. 2 shows such a weld connection 4. In this case, a further fiber 2 is connected to a bonding fiber 1 by a weld connection. The bonding fiber 1 is in this case made of the same material as the further fiber 2, namely a polyamide. Using the same polymer material for both fibers 1, 2 has the advantage inter alia that the weld connection 4 is more homogeneous and more durable than when joining different materials. By addition of an absorber additive in the form of carbon black, the bonding fiber 1 has become substantially absorbent in the range between 780 nm and 1100 nm. In FIG. 2, the absorber additive was in this case added into the bonding fiber 1, which when using carbon black may be seen from the continuous black coloration. As an alternative, an absorber additive may also be provided only on the surface of the bonding fiber 1.

LIST OF REFERENCES

1 bonding fiber
2 further fibers
3 base structure
4 material joining connections
10 nonwoven layer
20 base structure

The invention claimed is:

1. A clothing or press felt for a machine for producing or processing a fibrous material web, the clothing comprising:
a woven fabric base structure having an upper surface and
a fibrous structure comprising at least one fibrous layer of nonwoven fibers disposed on the upper surface of said base structure,
wherein said fibrous structure of nonwoven fibers comprises bonding fibers and further fibers,
wherein said bonding fibers and said further fibers differ in at least one material property,
wherein said bonding fibers differ from said further fibers in that said bonding fibers substantially absorb NIR radiation in a wavelength range between 780 nm and 1100 nm, and said further fibers are entirely or substantially transparent for radiation in said wavelength range, and
wherein, due to controlled energy input carried out by irradiation of the clothing in a wavelength that is absorbed by the bonding fibers, at least some of said bonding fibers are connected by weld connections to at least one of:
one or more of said further fibers and
elements of said base structure.

2. The clothing according to claim 1, which further comprises absorber additives disposed in or on said bonding fibers, said absorber additives absorbing NIR radiation in at least one wavelength range between 780 nm and 1100 nm.

3. The clothing according to claim 1, wherein said bonding fibers are provided in a proportion of less than 30 wt % of an entirety of said at least one layer of nonwoven fibers.

4. The clothing according to claim 3, wherein said proportion is less than 15 wt %.

5. The clothing according to claim 3, wherein said proportion is less than 8 wt %.

6. The clothing according to claim 1, wherein said bonding fibers are formed entirely or predominantly of a polymer material identical to a polymer material forming said further fibers.

7. The clothing according to claim 1, wherein said bonding fibers are formed entirely or predominantly of a polymer material different from a polymer material forming said further fibers.

8. The clothing according to claim 1, wherein said bonding fibers have a melting temperature equal to or greater than a melting temperature of said further fibers.

9. The clothing according to claim 1, wherein said bonding fibers are formed entirely or predominantly of a polyamide, a copolyamide, a polyurethane or a polyether-block-polyamide copolymer (PEBA).

10. The clothing according to claim 1, wherein said further fibers include at least two types B1 and B2 of fibers, and said type B1 and type B2 fibers differ in at least one of titer or polymer material.

11. The clothing according to claim 1, wherein said fibrous structure is connected to said base structure by needling.

12. A clothing or press felt for a machine for producing or processing a fibrous material web, the clothing comprising:
a woven fabric base structure having an upper surface and
a fibrous structure comprising at least one fibrous layer of nonwoven fibers disposed on the upper surface of said base structure,
wherein said fibrous structure of nonwoven fibers comprises bonding fibers and further fibers,
wherein said bonding fibers differ from said further fibers in that said bonding fibers substantially absorb NIR radiation in a wavelength range between 780 nm and 1100 nm, and said further fibers are entirely or substantially transparent for radiation in said wavelength range, and
wherein, due to controlled energy input carried out by irradiation of the clothing in a wavelength that is absorbed by the bonding fibers, at least some of said bonding fibers are connected by weld connections to at least one of:
one or more of said further fibers and
elements of said base structure.

* * * * *